United States Patent [19]

Albert

[11] 3,967,748

[45] July 6, 1976

[54] DRINKING RECEPTACLE VALVE MEANS

[75] Inventor: Kenneth J. Albert, 7212 Sunset Blvd., Hollywood, Calif. 90046

[73] Assignee: Thermo Seal, Los Angeles, Calif.

[22] Filed: July 11, 1975

[21] Appl. No.: 595,110

Related U.S. Application Data

[63] Continuation-in-part of Ser. No. 583,284, June 3, 1975, abandoned.

[52] U.S. Cl. ..... 220/90.4; 215/307; 220/329; 220/348; 222/508; 222/515

[51] Int. Cl.[2] ..... A47G 19/22

[58] Field of Search ..... 220/90.4, 87, 329, 348; 222/511, 515, 544, 563, 508, 509, 542, 487, 481.5; 277/30, 83, DIG. 4; 251/83, 82, 77, 251; 215/307

[56] References Cited

UNITED STATES PATENTS

| | | | |
|---|---|---|---|
| 322,569 | 7/1885 | Tafts | 222/518 |
| 385,328 | 6/1888 | Straffin et al. | 222/487 |
| 656,000 | 8/1900 | Wall | 222/518 |
| 923,808 | 6/1909 | Breth et al. | 251/83 |
| 2,027,458 | 1/1936 | Tepas | 251/77 |
| 2,122,540 | 7/1938 | Sedwick et al. | 222/509 |
| 2,447,870 | 8/1948 | Poleyn | 220/90.4 |
| 2,578,201 | 12/1951 | Nicorvo | 215/315 |
| 2,652,951 | 9/1953 | Esposito et al. | 222/511 |
| 3,220,617 | 11/1965 | Veistrup | 222/518 |

*Primary Examiner*—George E. Lowrance
*Assistant Examiner*—Allan N. Shoap

[57] ABSTRACT

The disclosure relates to a drinking receptacle and valve means wherein: hot or cold liquids may be safely contained and carried during intermittent drinking such that the liquids cannot be spilled and in the case of hot liquids the valve means is manually operable to open the drinking valve to allow drinking of liquid from the receptacle or container. The valve means comprising a lost motion mechanism coupled with a manually operable plunger such that the manually operable plunger first opens a relief valve to relieve steam and pressure from the interior of the container whereupon the plunger continues its motion to open the drinking valve so as to allow drinking of contents from the receptacle after steam and pressure has been relieved therefrom and to thereby avoid the danger of causing hot coffee or other beverages to gush from the drinking valve when opened. The relief valve being disposed on the opposite side of the cover of the receptacle from the drinking valve so that when the receptacle is tilted for drinking the relief valve is above the normal liquid level so that steam and pressure is relieved before the drinking valve is opened.

The disclosure also relates to a novel poppet valve means and seat structure having a resilient ring shaped valve member disposed on a frusto-conical support and resiliently deflectable into conformity with valve seat means in the cover of the drinking receptacle.

The disclosure also relates to novel plunger guide and cam means for opening the drinking valve and further to resilient means for closing the valve in cooperation with the cam means. Additionally, the disclosure relates further to resilient means in connection with the plunger for closing the relief valve after the drinking valve has been closed during releasing motion of the plunger by the operator or the person drinking from the aforementioned drinking valve.

22 Claims, 9 Drawing Figures

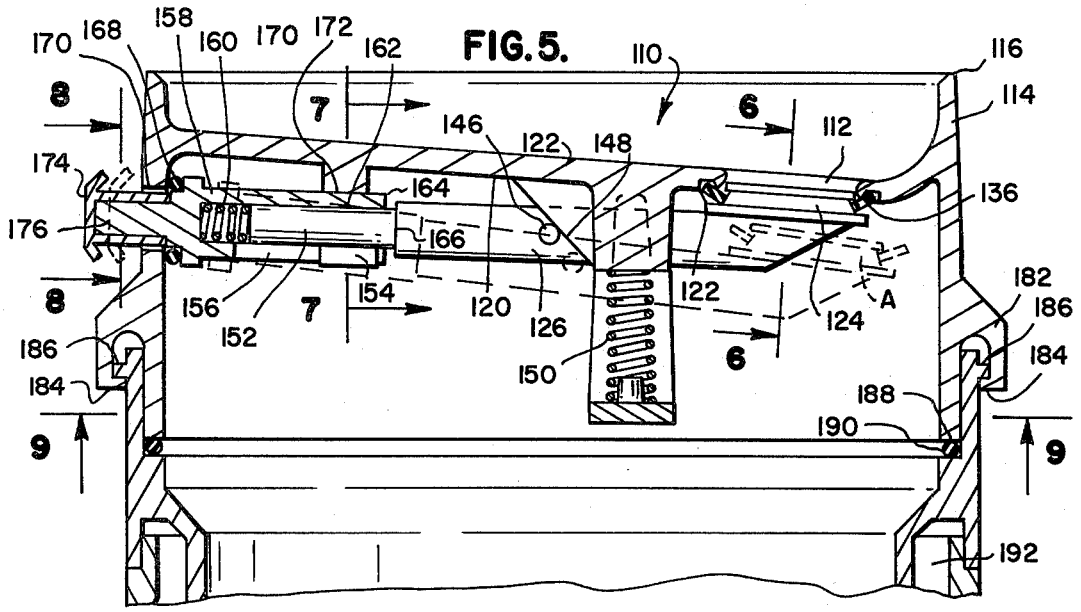
FIG.5.
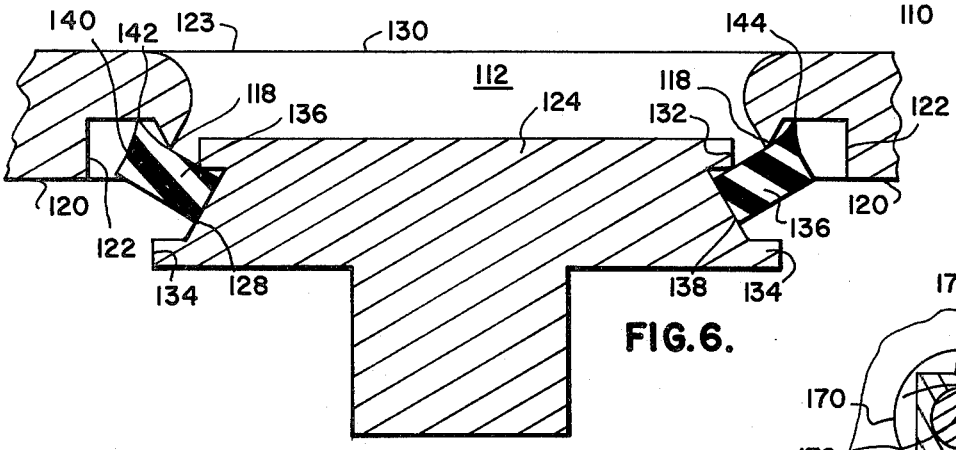
FIG.6.
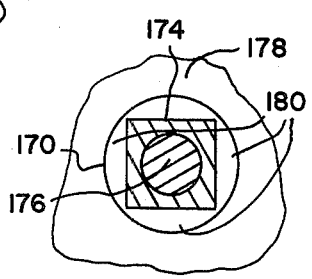
FIG.8.
FIG.7.
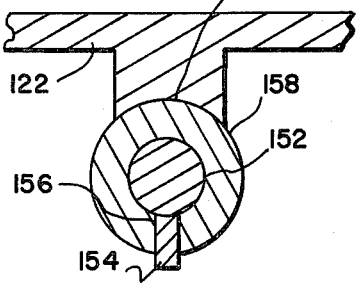
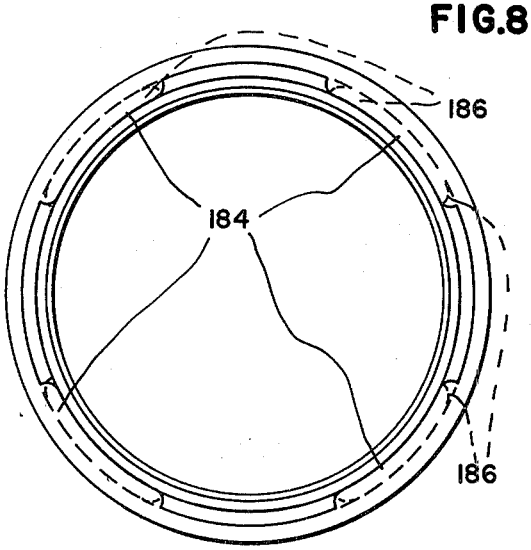
FIG.9.

DRINKING RECEPTACLE VALVE MEANS

This application is a continuation in part of my copending application for Drinking Receptacle Valve Means, Ser. No. 583,284, filed June 3, 1975, now abandoned.

BACKGROUND OF THE INVENTION

Various enclosures have been provided for drinking receptacles, particularly hot coffee or the like and such enclosures have included various valves for allowing a person to drink from such receptacles.

Prior art U.S. Pat. Nos. 2,578,201 and 3,739,938 are exemplary of the prior art. These patents both disclose manually operable valves in drinking receptacle covers but do not provide any means by which steam and pressure may be relieved from the interior of the container before the drinking valve is opened. Consequently, both prior art devices, as disclosed in these patents, concurrently provide for the relief of drinking liquid and steam or pressure so that the operation of these valves is dangerous, especially when hot coffee is contained in the container and the valve is opened such as to cause the hot liquid to gush out and burn the person attempting to drink therefrom.

SUMMARY OF THE INVENTION

The present invention provides means by which a drinking receptacle cover encloses a receptacle or container such as a beverage container which may be used for holding hot coffee or other beverages during intermittent drinking thereof so as to prevent spillage from the container or loss of heat or, in the case of cold beverages, to maintain them cool. In the cover of the invention is provided a manually operable valve so as to permit drinking of the contents from the container and associated with the manually operable drinking valve is a pressure relief valve actuated by a manually operable plunger such that the pressure relief valve is operated directly by an initial movement of the plunger and whereupon lost motion engaging means provides for initial movement of the relief valve without opening the drinking valve and whereupon continued movement of the plunger after the pressure relief valve is opened causes opening of the drinking valve thereby only permitting the drinking of liquid from the valve after pressure has been relieved from the interior of the container. Accordingly, the valve means of the invention provides for complete enclosure of liquids in a thermally insulated cup and provides for safe drinking of the contents of the receptacle such as hot coffee or the like. The invention comprises novel telescopic lost motion means interconnecting the pressure relief valve of the invention and the drinking valve so that when the manually operable plunger is actuated the pressure relief valve is first operated then the lost motion means causes actuation of the drinking valve to permit a person to drink from the drinking opening in the cover of the receptacle of the invention.

The invention comprises a very novel valve and seat means wherein a normally flat resilient ring shaped gasket is mounted on a frusto-conical support member and is engageable with an annular sharp edge seat structure so as to provide for accuracy in seating of the valve and sealing thereof relative to an opening in a drinking receptacle cover and also to provide for the positive sealing of the valve with nominal spring closing pressure whereby ease of operation of the valve may be readily attained and whereby pressure internally of the receptacle readily causes the valve efficiently to seal and to compensate for any inaccuracies in the valve seat structure such as may be encountered in the injection moulding of the parts.

The invention also comprises specific mechanism for actuating the relief valve as well as the drinking valve. The manually operable plunger of the invention extends through the cover from the outside to the inside thereof and telescopic means connects the plunger with a movable member which is cam operated by means of a cam on the lower inner side of the cover so as to open the drinking valve which is generally a poppet shaped valve seating in a drinking opening in the lower side of the cover and a spring is carried by a yoke connected to the cover and tends to close the drinking valve as well as to operate the movable member carrying the valve on the cam means at the lower side of the cover. A second spring in connection with the telescopic mechanism holds the aforementioned relief valve closed around an opening in the side of the cover, the opening being the one which the plunger extends through but said opening being larger than the diameter of the plunger so as to permit the relief of pressure from the inside of the container around the plunger. The relief valve being in the form of an O-ring carried by a shoulder on the plunger and adapted to overlap the relatively enlarged opening around the plunger in the side of the receptacle cover.

The relief valve is disposed at an opposite side of the cover from the drinking valve so that when the cover is disposed in drinking position the relief valve is above the normal liquid level allowing it to relieve steam from the container so that the hot liquid is not under pressure when the drinking valve is subsequently opened.

Accordingly, it is an object of the present invention to provide a novel drinking receptacle valve means which is operable initially to relieve pressure in the drinking receptacle and subsequently to open the drinking receptacle valve after the pressure has been relieved so as to provide for safety of persons drinking hot coffee from such receptacles.

Another object of the invention is to provide a novel manually operable plunger mechanism with a lost motion actuating means disposed between the pressure relief valve and the drinking valve so that they are operated in sequence.

Another object of the invention is to provide a pressure relief valve disposed on the opposite side of the drinking cover from the drinking valve so that in normal drinking position the relief valve is above the liquid level in the drinking container and to thereby operate for the relief of steam without allowing liquid to be dispensed from the relief valve when it is opened preliminary to the opening of the drinking valve.

Another object of the invention is to provide a very novel valve and seat means for use in connection with covers of drinking receptacles wherein a resilient readily deflectable ring shaped gasket member is mounted on a frusto-conical support means so that the periphery of the ring shaped resilient member may efficiently seal around a drinking opening and readily compensate for inaccuracies of parts such as may be encountered in injection moulding and also to provide for the use of a nominal spring pressure so that actuating forces attendant to the opening of the valve may be reasonably nominal.

Further objects and advantages of the invention may be apparent from the following specification, appended claims and accompanying drawings.

BRIEF DESCRIPTION OF THE DRAWINGS

FIG. 5 is a view similar to FIG. 2 showing modifications of the invention and illustrating preferred embodiments thereof;

FIG. 6 is an enlarged fragmentary sectional view taken from the line 6—6 of FIG. 5;

FIG. 7 is an enlarged fragmentary sectional view taken from the line 7—7 of FIG. 5;

FIG. 8 is an enlarged fragmentary sectional view taken from the line 8—8 of FIG. 5; and FIG. 9 is a reduced sectional view taken from the line 9—9 of FIG. 5.

DESCRIPTION OF THE PREFERRED EMBODIMENTS

Figure 1:
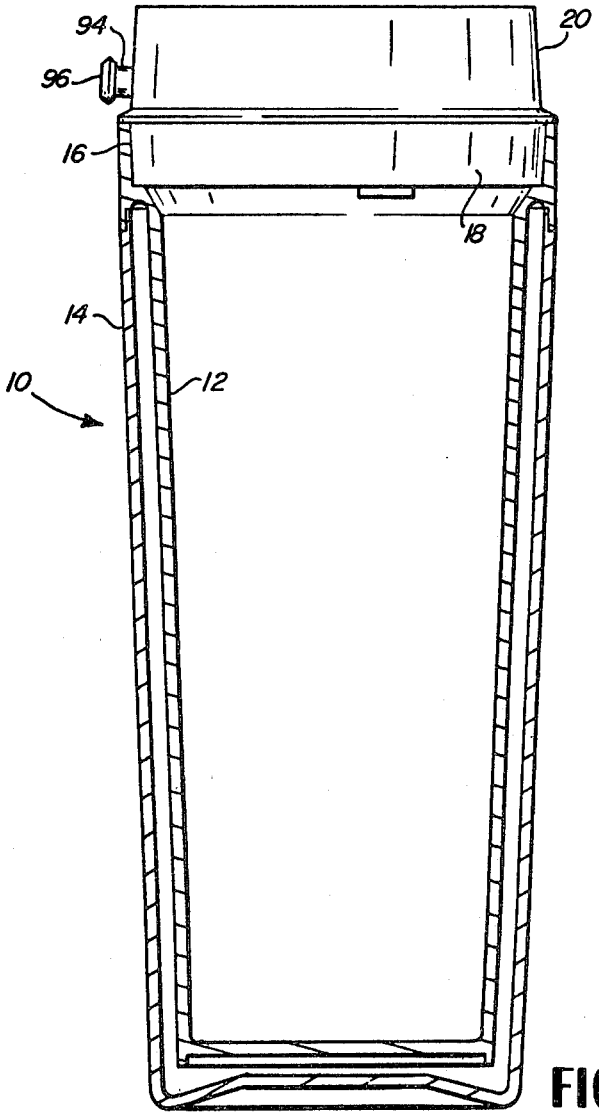
FIG. 1 is a side elevational view of the drinking receptacle valve means of the invention in a container or receptacle cover and showing a thermally insulated receptacle in section and coupled to the receptacle cover.

As shown in FIG. 1, a thermally insulated receptacle or container is designated 10. This container is provided with inner and outer walls 12 and 14 which are spaced apart to provide for thermal insulation either for holding the heat in hot coffee or the like or for maintaining cold beverages as desired.

The container 10 is provided with an annular internal bore portion 16 in which a skirt portion 18 of a cap or cover 20 is sealingly engaged. The cover 20 is a generally hollow cylindrical member having an enclosing top portion 22 provided with a drinking opening 24 therein. This drinking opening is adjacent to an upwardly extending drinking lip 26 and the top portion 22 is generally declined downwardly toward the drinking opening and toward the lip 26 providing a flow recess 28 adjacent to the drinking edge or lip 26 of the cover 20.

The opening 24 is preferably a circular opening and is enclosed by a valve member 30 which is provided with a peripherally connected O-ring 32. This O-ring being resiliently retained in a groove 34 in the generally circular valve member 30. Thus the O-ring 32 seats around the periphery of the opening 24 in a generally chamfered valve seat 36, all as shown best in FIG. 2 of the drawings.

The valve member 30 is carried by a movable member 38 which is reciprocally and slideably mounted between spaced apart downwardly extending portions 40 and 42 of the cover portion 22. The spaced relationship of the portions 40 and 42 provides a generally slot shaped structure between which the movable member 38 is reciprocally mounted as well as vertically movably mounted. Thus the movable member 38 is capable of moving longitudinally and upwardly and downwardly in accordance with the broken line disclosure of FIG. 2 of the drawings.

The downwardly extending portions 40 and 42 are provided with socket portions 44 and 46 respectively. These socket portions 44 and 46 receive normally upper ends 48 and 50 of a yoke member 52 which supports a coil spring 54. The coil spring 54 at its lower end 56 surrounding an upwardly extending coil holding boss 58 which is integral with the yoke 52.

Figure 3:
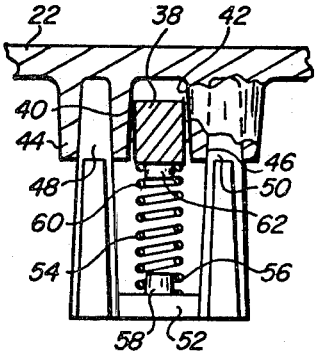
FIG. 3 is a fragmentary sectional view taken from the line 3—3 of FIG. 2.

The upper end of the spring 54 is designated 60 and it surrounds a downwardly extending boss 62 which is integral with the movable member 38, all as shown best in FIG. 3 of the drawings.

The portions 48 and 50 of the yoke 52 are tapered and fitted in the sockets 44 and 46 and may be bonded thereinto by various cementitious materials or solvent materials for plastics if compatible with the cover 22 and the yoke 52.

Integral with the socket portions 44 and 46 are cam portions 64 and 66. These cam portions 64 and 66 are adjacent the respective guide portions 40 and 42 shown in FIG. 3. These cam portions 64 and 66 are also integral with the top portion 22 of the cover 20 and, as shown in FIG. 2, are downwardly declining from the top portion 22 to the lower portions of the sockets 44 and 46, all as shown best in FIG. 2 of the drawings.

Figure 2:
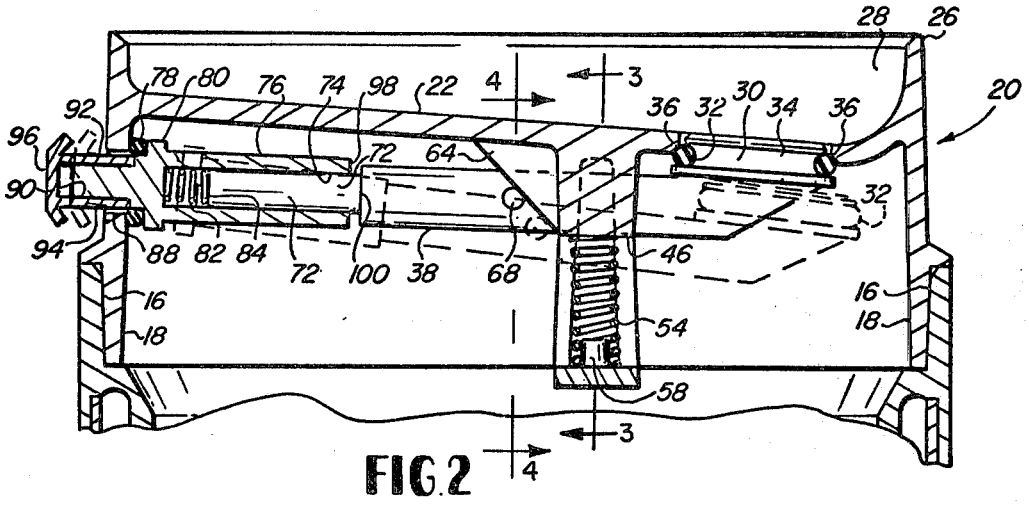
FIG. 2 is an enlarged fragmentary sectional view of the receptacle cover of the invention showing the drinking receptacle valve means therein and illustrating parts and portions broken away and in section in varying positions of the mechanism being illustrated by broken lines.
Figure 4:
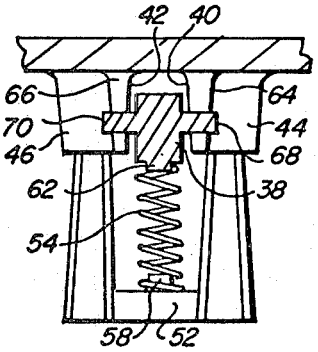
FIG. 4 is a fragmentary sectional view taken from the line 4—4 of FIG. 2.

The movable member 38 is provided with a pair of trunions 68 and 70 which engage the respective cam portions 64 and 66, all as shown best in FIGS. 2 and 4 of the drawings.

Integral with the movable member 38 is a reduced diameter shank portion 72 which is telescopically mounted in a bore 74 of a plunger 76. This plunger 76 being provided with an O-ring pressure relief valve 78 which is carried on an arcuate or annular shoulder 80 of the plunger 76.

Disposed in the bore 74 is a spring 82 acting on an end 84 of the reduced diameter portion 72 and tending to hold the valve O-ring 78 against an inner side wall 86 of the cover 20. The side wall 86 is provided with an opening 88 through which a manually engageable portion 90 of the plunger 76 is mounted. The opening 88 being larger than the diameter of the shank 90 so as misalignment provide a valve opening which is sealed by the O-ring valve 78 in accordance with pressure of the spring 82.

The plunger 76 at its outboard end is provided with a reduced diameter portion 92 over which a hollow shank 94 of the manually operable knob 96 is fitted and secured. This structure is provided for assembly purposes so as to permit the enlarged manually operable knob 96 to be installed on the outer side of the annular wall of the cover 20 and in this manner some solvent or cement may be placed in the hollow shank 94 of the member 96 as it is inserted over the reduced diameter portion 92 of the plunger 76 and this being done after the reduced diameter portion 92 is projected through the opening 88. Thus the final assembly of the structure is made.

The hollow portion 94 of the manually engageable knob 96 may be pressed on the reduced diameter portion 92 of the plunger 76, if desired.

The plunger 76 is provided with an abutment end 98 normally spaced from an abutment shoulder 100 which forms a transition between the main body of the shank 38 and the reduced diameter portion 72.

The spacing between the abutment portions 98 and 100 provides for a lost motion relationship between the plunger 76 and the movable member 38 so as to permit initial movement of the relief valve 78 from its position around the enlarged opening 88 so that steam may be relieved before the abutment portion 98 touches the abutment portion 100 and starts to open the valve member 30 relative to the drinking opening 36. In this manner, the relief of steam and pressure from the receptacle is accomplished when the receptacle is tilted so that the relief valve 78 is above the level of the liquid and the liquid is in the area of the valve member 30 and the drinking opening 24 adjacent the drinking lip 26.

As the lost motion mechanism comprising the two abutment portions 98 and 100 permits opening of the valve 78 initially, the pressure is released and then when the abutment portions 98 and 100 engage further inward pressure on the manually operable portion 96 of the plunger 76 causes the movable member 38 to actuate the cam followers 68 and 70 in a downwardly declining direction on the respective cam surfaces 64 and 66 so as to move the valve member and its associated O-ring 32 downwardly into the broken line position shown in FIG. 2 of the drawings allowing liquid to be released gravitationally through the opening 24 and to be drunk by the person whose lips are at the lip engaging edge 26, as shown in FIG. 2 of the drawings. When pressure is released manually from the actuating portion 96 of the plunger 76, the spring 54 forces the movable member 38 upwardly and the cam followers 68 and 70 follow the respective cam surfaces 64 and 66 so as to reposition the O-ring 32 and valve member 30 in the solid line position, as shown in FIG. 2 of the drawings, whereupon further release of the manually operable portion 96 of the plunger 76 allows the spring 82 to extend the plunger 76 in telescopic relation to the reduced diameter portion 72 in a direction to cause the O-ring 78 to seat tightly around the enlarged opening 88 through which the shank 90 of the plunger extends thus causing final sealing of the container cover after a drinking operation has been performed through the drinking opening 24.

In the modified structure, as shown in FIGS. 5 and 6, a preferred valve and valve seat structure is disclosed. This structure comprises a receptacle cover 110 similar to the cover 20 hereinbefore described. This cover 110 is provided with a generally circular drinking opening 112 which is quite close to the annular peripheral portion 114 of the cover at which a lip engaging edge 116 is disposed.

The opening 112, as shown on enlarged scale in FIG. 6 of the drawings, is provided with a sharp generally V shaped in cross section annular seat portion 118 which is directed downwardly toward an inner or lower side 120 of the top portion 122 of the cover 110.

The annular structure 118 is primarily a valve seat structure and is disposed internally of an annular recess 122 in the lower side 120 of the cover 110.

A poppet valve 124 is carried by a movable member 126 similar to the member 38 hereinbefore described. This poppet valve 124 is generally circular in cross section and is provided with a frusto-conical portion 128 which converges toward an upper side 130 of the cover portion 122. An annular flange 132 is disposed in overlying relation with the uppermost portion of the frusto-conical portion 128 while an underlying annular flange 134 is extended radially beyond the lowermost portion of the frusto-conical portion 128, all as shown best in FIG. 6 of the drawings.

An annular ring shaped gasket 136 is provided with a bore portion 138, normally smaller in diameter than the frusto-conical portion 128, and this bore portion is resiliently and firmly engaged on the frusto-conical portion 128 so as to deflect the ring shaped gasket 136 into a generally disc shaped structure whereas this gasket 136 is normally flat.

The disposition of the gasket, as shown in FIG. 6, is such that the ring shaped structure of this gasket is generally in a downwardly converging frusto-conical shape and a peripheral edge 140 of the gasket is provided with an annular corner 142 which is resilient and readily deflectable and engageable with the recess portion 122 at 144 so as to provide a double sealing seat which is very flexible and capable of compensating for irregularities in the cast structure of the opening 112 and seat structure 118 as well as the recess 122.

Due to the resilient character of the ring shaped gasket 136 and its mounting on a frusto-conical portion 128, it may be deflectable into close conformity with the ring shaped seat 118 even though this seat may be slightly warped due to injection molding processes and, therefore, the gasket 136 on the poppet valve member 124 provides the solution to the production of an efficient sealing valve by injection molding of plastic parts such as the parts including the cover 110 and the poppet valve 124 together with its integral movable member 126 which carries cam following pins 146 similar to the respective cam follower structure 68, shown in FIG. 2 of the drawings.

These cam follower structures 146 operate on inclined cams 148 similar to the cams 64 hereinbefore described. A return spring 150 is similar to the hereinbefore described spring 54 except that this spring 150 may be of lighter loading such as will be hereinafter described in detail.

As shown in FIG. 5 of the drawings, the movable member is provided with a circular in cross section shank 152 which is also shown in FIG. 7 of the drawings. This shank 152 is provided with an integral fin 154 which projects through an open slot 156 in a plunger member 158. This plunger member 158 is similar to the plunger 76 hereinbefore described, however, the slot 156 provides an opening for cleaning and washing such as may be encountered when the device is put in a diswasher and the cleaning water thus has access through the slot 156 to areas around the relief valve return spring 160 which is similar to the spring 82 hereinbefore described. The fin 154 holds the slot 156 oriented in a direction away from the lower surface 120 of the top 122 so that water projected in a dishwasher will readily enter around the spring 160 and clean the structure. The fin 154 being integral with the shank 152 and the movable member 126 is prevented from rotating and the plunger member 158 is provided with a bore 162 in which the shank 152 is reciprocally mounted and an end 164 of the plunger 158 is spaced from a shoulder 166 of the movable member 126 to provide for lost motion operation of the device as hereinbefore described relative to the opening of a relief valve gasket 168 relative to a relief opening 170 which is similar to the structure hereinbefore described, the gasket 168 being similar to the gasket 78 hereinbefore described in connection with FIG. 2 of the drawing.

The cover top portion 122 is provided with a downwardly projecting support bearing 172 which is shown in FIG. 7 of the drawings. This bearing 172 supports the upper portion of the plunger 158 and resists forces of the spring 150 tending to deflect the movable member 126 and the plunger 158 and to thereby avoid the possibility of misalignement of the valve poppet 124 relative to the seat 118.

A manually engageable knob 174 projects through the opening 170 and is frictionally engaged on a stub 176 of the plunger 158. The stub 176 being shown in FIG. 8 together with a generally rectangular in cross section exterior of the manually operable member 174. The rectangular cross section of the member 174, as shown in FIG. 8, is disposed in the generally circular opening 170 in the side wall 178 of the cover 110. Thus spaces 180 disposed radially outward from the rectangular in cross section portion 174 provide for the relief of pneumatic fluid such as steam or beverage carbonation from the interior of the receptacle on which the cover 110 is mounted and in accordance with the description of operation of the structure shown in FIG. 2 of the drawings, the manual knob 174 may first be pressed inwardly relieving the gasket 168 from its seat around the inner side of the cover and the opening 170 so as to first release pneumatic fluid under pressure before the end portions 164 and 166 of the plunger and the movable member 126 respectively are engaged for subsequently forcing the poppet valve 124 off its seat and into a broken line position A as shown in FIG. 5 of the drawings, whereby liquid may subsequently be poured through the opening 112 and be drunk by a person over the drinking edge 116. It will be understood that, as hereinbefore described, while the drinking opening 112 is disposed downwardly, the relief valve 168 is in an upward position above the liquid in the container or receptacle to thereby allow the pneumatic fluid under pressure to escape through the opening 170 so that no hot coffee or other similar beverages may be forced or gushed into the drinker's mouth.

In connection with the cover 110, an integral bayonet lock skirt 182 is provided with inwardly directed arcuate section 184, all as shown in FIGS. 5 and 9 of the drawings. These segments interlock with bayonet locking segments 186, all as shown in FIGS. 5 and 9 of the drawings, and these segments are rotated into position on a slight incline to force an annular skirt 188 of the cover into firm engagement with an annular O-ring 190 which provides a gasket between the cover and a femoral walled receptacle 192.

It will, therefore be understood that the spring 54 is primarily responsible for closing the pressure relief valve 78.

It will be obvious to those skilled in the art that various modifications may be resorted to without departing from the spirit of the invention.

I claim:

1. In a drinking receptacle valve means; a receptacle cover; said cover having a lip engaging edge; said cup having a drinking opening therein adjacent said edge; a drinking valve member adapted to close said opening; a movable member carrying said valve means; first means cooperable with said movable member and said cover for opening said valve member relative to said drinking opening; a manually operable and reciprocable plunger extending from the exterior to the interior of said cover; said plunger adapted to engage said movable member to force it and said first means to open said valve member relative to said drinking opening; a relief valve operable by said manually operable plunger; said relief valve adapted to relieve steam and fluid pressure from the interior of said cover to atmosphere; and lost motion engaging means disposed between said plunger and said movable means whereby manual movement of said plunger initially operates said relief valve and upon further movement of said plunger said lost motion engaging means opens said drinking valve member after said relief valve has relieved fluid pressure from inside said cover.

2. The invention as defined in claim 1, wherein: said lost motion engaging means comprises a telescopic means coupling said plunger and said movable member; and stop means disposed to positively limit telescopic movement of said plunger relative to said movable member after said relief valve has been opened by the initial movement of said plunger and during relative telescopic movement between said plunger and said movable member.

3. The invention as defined in claim 1, wherein: said first means comprises cam means cooperable with said movable member and said cover for opening said valve member relative to said drinking opening; resilient means tending to hold said drinking valve closed; said resilient means thereby forcing cooperable action of said cam means to move said drinking valve to closed position relative to said drinking opening.

4. The invention as defined in claim 3, wherein: said cover is provided with a lower inner portion; said cam means comprising a downwardly declining portion at said lower inner portion of said cover; said movable member having a follower engaging said declining portion for moving said drinking valve downwardly away from said drinking opening in response to manual force on said plunger.

5. The invention as defined in claim 4, wherein: guide means is provided for said movable member; said guide means being carried by said cover and disposed between said drinking valve and said plunger; said guide means straddling said movable member and having a normally vertically disposed slot in which said movable member is movable operable horizontally and also movably vertically in said guide means in accordance with said declining portion of said cam.

6. The invention as defined in claim 1, wherein: a spring is disposed to close said relief valve.

7. The invention as defined in claim 6, wherein: said lost motion engaging means comprises telescopic means coupling said plunger and said movable member; and stop means disposed to positively limit telescopic movement of said plunger relative to said movable member after said relief valve has been opened by initial movement of said plunger and during relative telescopic movement between said plunger and said movable member; and a spring disposed and tending to force said telescopic means apart and to close said relief valve; said relief valve being an annular valve member adapted to engage an inner side of said cover; said plunger extending through an opening in said cover and being slightly larger than said plunger whereby said relief valve closes the space in the side of said cover around said plunger.

8. The invention as defined in claim 7, wherein: said cover is provided with a lower inner portion; said cam means comprising a downwardly declining portion at said lower inner portion of said cover; said movable member having a follower engaging said declining portion for moving said drinking valve downwardly away from said drinking opening in response to manual force on said plunger; a second spring disposed to force said drinking valve into closed position relative to said drinking opening; said second spring supported in connection with said cover.

9. The invention as defined in claim 6, wherein: a second spring is disposed and tending to hold said drinking valve closed; said second spring disposed to force cooperable action of said cam means to move said drinking valve to closed position relative to said drinking opening.

10. The invention as defined in claim 8, wherein: said cover is provided with guide means for said movable member; said guide means being carried by said cover and disposed between said drinking valve and said plunger; said guide means straddling said movable member and having a normally vertically disposed slot in which said movable member is movable horizontally and also normally vertically in said guide means in accordance with said declining portion of said cam.

11. The invention as defined in claim 1, wherein: said cover is provided with cup engaging and holding means; and a drinking receptacle having an upper portion secured to said cup engaging and holding means.

12. The invention as defined in claim 9, wherein: said cover is provided with a receptacle engaging and holding means; and a receptacle having an upper open end secured to said engaging and holding means.

13. The invention as defined in claim 1, wherein: a thermally insulated cup is sealably connected to said cover.

14. The invention as defined in claim 1, wherein: said first means comprises cam means.

15. The invention as defined in claim 14, wherein: said cam means is integral with said cover and comprises a downwardly declining portion and follower means on said movable member disposed and adapted to slide downwardly on said downwardly declining portion.

16. The invention as defined in claim 1, wherein: said plunger and said relief valve are disposed at an opposite side of said cover from said drinking opening whereby, when said cover is in tilted drinking position, liquid gravitates below said relief valve and allows steam to escape therethrough above the liquid level.

17. A drinking receptacle provided with a generally cup like body having a normally upper open end; a cover for said body removably and sealingly secured to said upper open end of said cup like body; said cover having a peripheral rim and a top plate portion surrounded by said rim; said top plate portion having upper and lower sides; said top plate portion having a drinking opening extending therethrough; said drinking opening being at a first location near the proximity of said rim; an openable valve disposed and adapted to close and open said drinking opening; said top plate portion having upper and lower sides; said valve disposed adjacent said lower side and disposed to close said drinking opening whereby pressure in said cup like body tends to hold said valve closed; a finger engageable valve actuator movably mounted on said cover and being disposed at a second location near the proximity of said rim; said valve actuator operably disposed relative to said valve for opening and closing the same; said second location being substantially diametrically opposed to said first location whereby said receptacle may be tilted to a disposition wherein said drinking opening is in a downward position and said valve actuator is in a relatively upward position; said valve being a poppet valve having a generally circular shape; said drinking opening in said top plate portion being generally circular; said top plate portion having an annular valve seat surrounding said opening; said poppet valve having a frusto-conical convergingly tapered in a direction toward said upper side of said top plate portion; a resilient ring shaped gasket which is normally flat; said gasket provided with a sharp peripheral corner portion; said ring shaped gasket having a bore portion normally smaller than the diameter of said frusto-conical portion; said bore portion disposed on and resiliently surrounding and gripping said frusto-conical portion so as to deflect and hold said normally flat ring shaped gasket in a generally disc shaped configuration which is generally frusto-conical and downwardly converging with one of said sharp peripheral corners disposed to resiliently engage said annular valve seat.

18. The invention as defined in claim 17, wherein: said annular valve seat comprises a downwardly converging in cross section annular portion having a sharp annular edge directed towards a gasket.

19. The invention as defined in claim 17, wherein: said sharp peripheral corner is provided with a resilient lip extending slightly beyond said flat ring shaped configuration.

20. The invention as defined in claim 4, wherein: said cover is provided with support means holding said spring to act on said plunger in a direction towards said cover; and bearing means movably supporting said plunger and disposed to resist lateral deflection of said plunger to maintain arcuate alignment of said valve member with said drinking opening.

21. The invention as defined in claim 1, wherein: said relief valve comprises a gasket means disposed at an inner side of said cover; said gasket means carried by said plunger; said cover having a relief opening through which said plunger extends; the cross sectional shape of said opening and said plunger being different and bearing concentrically only at a plurality of locations and having spaces between said locations whereby venting through said relief opening around said plunger may occur while reciprocal alignment of said plunger and said movable member remains substantially consistent.

22. The invention as defined in claim 2, wherein: said telescopic means comprises a hollow tubular portion integral with said plunger; a shank portion of said movable member in said hollow tubular portion; said hollow tubular portion having a slot in the side wall thereof for access of cleaning water; and a guide carried by said movable member; said guide portion movable in said top portion; said movable member restrained against rotation relative to said cover whereby said slot is held in a position facing away from said cover and thereby opened to water which may be thrown in a dishwasher or the like.

* * * * *

UNITED STATES PATENT AND TRADEMARK OFFICE

CERTIFICATE OF CORRECTION

PATENT NO. : 3,967,748

DATED : July 6, 1976

INVENTOR(S) : Kenneth J. Albert

It is certified that error appears in the above-identified patent and that said Letters Patent are hereby corrected as shown below:

In the drawings, Sheet 1, Fig. 2, the reference numeral 24 should be applied to the drinking opening in the top portion 22 of the cover 20.

Column 7, line 55, the word "cup" should read --cover--.

Column 7, line 58, the word "means" should read --member--.

Column 8, line 2, the word "means" should read --member--.

Column 8, line 41, after the word "cam" insert --means--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*